US010119766B2

(12) United States Patent
Lin et al.

(10) Patent No.: US 10,119,766 B2
(45) Date of Patent: Nov. 6, 2018

(54) HEAT DISSIPATION DEVICE

(71) Applicant: ASIA VITAL COMPONENTS CO., LTD., New Taipei (TW)

(72) Inventors: Yu-Min Lin, New Taipei (TW); Wen-Ji Lan, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 77 days.

(21) Appl. No.: 14/956,342

(22) Filed: Dec. 1, 2015

(65) Prior Publication Data

US 2017/0153066 A1 Jun. 1, 2017

(51) Int. Cl.

| | |
|---|---|
| ***F28D 15/04*** | (2006.01) |
| ***F28D 15/02*** | (2006.01) |
| ***F28F 1/32*** | (2006.01) |

(52) U.S. Cl.

CPC ..... *F28D 15/0266* (2013.01); *F28D 15/0275* (2013.01); *F28D 15/046* (2013.01); *F28F 1/32* (2013.01)

(58) Field of Classification Search

CPC .... F28D 15/0266; F28D 15/02; F28D 15/046; F28D 15/0275; F28D 15/0283; F28D 15/04; F28D 15/0233; B23P 2700/09; Y10T 29/49353; F28F 2210/00

USPC ..... 165/104.26, 80.4

See application file for complete search history.

(56) References Cited

U.S. PATENT DOCUMENTS

| | | | | |
|---|---|---|---|---|
| 5,647,430 | A * | 7/1997 | Tajima | F28D 15/0266 165/104.21 |
| 6,237,223 | B1 * | 5/2001 | McCullough | B23P 15/26 257/E23.089 |
| 6,843,307 | B2 * | 1/2005 | Yuyama | F28D 15/0233 165/104.21 |
| 7,106,589 | B2 * | 9/2006 | Kiley | F28D 15/0266 165/104.14 |
| 7,540,318 | B2 * | 6/2009 | Nitta | F28D 15/0233 165/104.26 |
| 7,926,553 | B2 * | 4/2011 | Dautert | G06F 1/20 165/104.14 |
| 8,737,071 | B2 * | 5/2014 | Hao | H01L 23/427 165/104.21 |
| 9,436,235 | B2 * | 9/2016 | Damaraju | G06F 1/20 |
| 2003/0183372 | A1 * | 10/2003 | Lai | F28D 15/04 165/104.26 |

(Continued)

FOREIGN PATENT DOCUMENTS

| | | |
|---|---|---|
| CN | 100470446 C | 3/2009 |
| TW | M259945 | 3/2005 |
| TW | 201041492 A1 | 11/2010 |

*Primary Examiner* — David Teitelbaum
*Assistant Examiner* — Paul Schwarzenberg
(74) *Attorney, Agent, or Firm* — C. G. Mersereau; Nikolai & Mersereau, P.A.

(57) ABSTRACT

A heat dissipation device includes a housing and a heat pipe. The heat pipe has an open end, which is inserted into an opening on a top side of the housing, such that a heat pipe chamber of the heat pipe is communicated with a housing chamber of the housing and an extended portion extended from the open end of the heat pipe is pressed against a bottom side of the housing, as well as a heat pipe wick structure of the heat pipe is connected to a housing wick structure of the housing, so as to increase heat transfer effect.

7 Claims, 7 Drawing Sheets

(56) References Cited

U.S. PATENT DOCUMENTS

2010/0263834 A1* 10/2010 Hwang ..... H01L 23/3672
165/104.26

* cited by examiner

HEAT DISSIPATION DEVICE

FIELD OF THE INVENTION

The present invention relates to a heat dissipation device, and more specifically, to a heat dissipation device having largely increased heat transfer effect and heat dissipation efficiency, so as to save manufacturing costs.

BACKGROUND OF THE INVENTION

The currently available electronic mobile devices have become extremely thin and light. Apart from being thin and light, the new-generation electronic mobile devices have also largely improved computation performance. Due to the improved computation performance and the largely reduced overall thickness, an internal space of the electronic mobile devices for disposing electronic elements is also limited. The higher the computation performance is, the more amount of heat the electronic elements produce during operation. Therefore, vapor chambers and heat pipes are widely used to dissipate the heat produced by the electronic elements.

A vapor chambers normally has a rectangle housing, which has a wick structure and a working fluid provided therein. One side of the housing, i.e. the evaporating section, is attached to a heat-generating element, such as a central processing unit (CPU), south/north bridge chipset, or transistor, to absorb heat produced by the heat-generating element and then evaporated. Thereafter, the evaporated heat is dissipated via a condensing section and condensed into liquid due to capillary force, then flowed back to the evaporating section to complete the whole inclosed circulation.

The operating principle of a heat pipe is similar to the vapor chamber ○ The heat pipe dissipates heat mainly through a vapor-liquid circulation occurred therein. More specifically, the heat pipe has an evaporating and a condensing end. The evaporating end is in contact with a heat generating element, such that the working fluid located at the evaporating end is heated and vaporized. The vaporized working fluid flows through the chamber to the condensing end, at where the working fluid is condensed into liquid. The liquid working fluid then flows back to the evaporating end with the help of a capillary force of the wick structure.

The difference between the heat pipe and the vapor chamber is that the vapor chamber helps spreads the heat in two dimensions across the vapor chamber area (in-plane spreading) and also conducts the heat in a vertical direction (through-plane), but the heat pipe dissipates the heat only in one dimension, i.e. distant heat dissipation. Currently, only one heat pipe or one vapor chamber attached to electronic elements cannot meet the requirement of heat dissipation. It is therefore tried by the inventor to develop how to combine the heat pipe with the vapor chamber to increase the heat transfer effect.

SUMMARY OF THE INVENTION

To solve the above problems, a primary object of the present invention is to provide a heat dissipation device that can increase heat transfer effect by making a heat pipe communicable with a housing of the housing and a heat pipe wick structure of the heat pipe connected to a housing wick structure of the housing.

Another object of the present invention is to provide a heat dissipation device that can save the manufacturing cost by an open end of the heat pipe inserted into a bottom side of the housing as the copper portion of the conventional vapor chamber.

A further object of the present invention is to provide a heat dissipation device that can increase the utilization ratio thereof.

To achieve the above and other objects, the heat dissipation device provided according to the present invention includes a heat pipe and a housing. The housing has a housing chamber and at least one opening. A working fluid and a wick structure are provided in the housing chamber. The opening is extended through a top side of the housing and communicated with the housing chamber. The heat pipe has a heat pipe wall, a closed end, and an open end. The heat pipe wall has an outer and an inner side. An extended portion is integrally extended from the open end, and the inner side of the heat pipe wall internally defines a heat pipe chamber communicated with the open end. A heat pipe wick structure is formed on the inner side of the heat pipe wall. The open end of the heat pipe is inserted into the opening of the housing, and the extended portion of the open end of the heat pipe is connected to a bottom side of the housing chamber of the housing. Further, the heat pipe chamber is connected to the housing chamber via the open end of the housing, and the heat pipe wick structure is communicated with the housing wick structure. With these arrangements, the heat dissipation device has largely increased heat transfer effect and utilization ratio and saves the manufacturing cost.

In an embodiment, the heat pipe wick structure formed on the inner side of the heat pipe wall is connected to the housing wick structure formed on the top side in the housing chamber of the housing, whereas the heat pipe wick structure in the extended portion of the heat pipe is connected to the housing wick structure on the bottom side in the housing chamber of the housing.

In an embodiment, the housing has at least one raised portion, which is upwardly extended from the periphery of the opening of housing, and an inner wall of the opening together an inner side of the raised portion of the housing is connected to the outer side of the heat pipe.

In an embodiment, the housing further includes a lateral and a bottom side, which is formed between the top and the bottom side, and the housing chamber is defined between the top, the bottom, and the lateral side.

In an embodiment, the open end of the heat pipe is vertically inserted into the opening of housing, and the housing chamber is communicated with the heat pipe chamber.

In an embodiment, the housing is a vapor or a heat pipe.

In an embodiment, a heat radiation fin assembly is vertically extended through the heat pipe and connected to the outer side of the heat pipe wall of the heat pipe.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
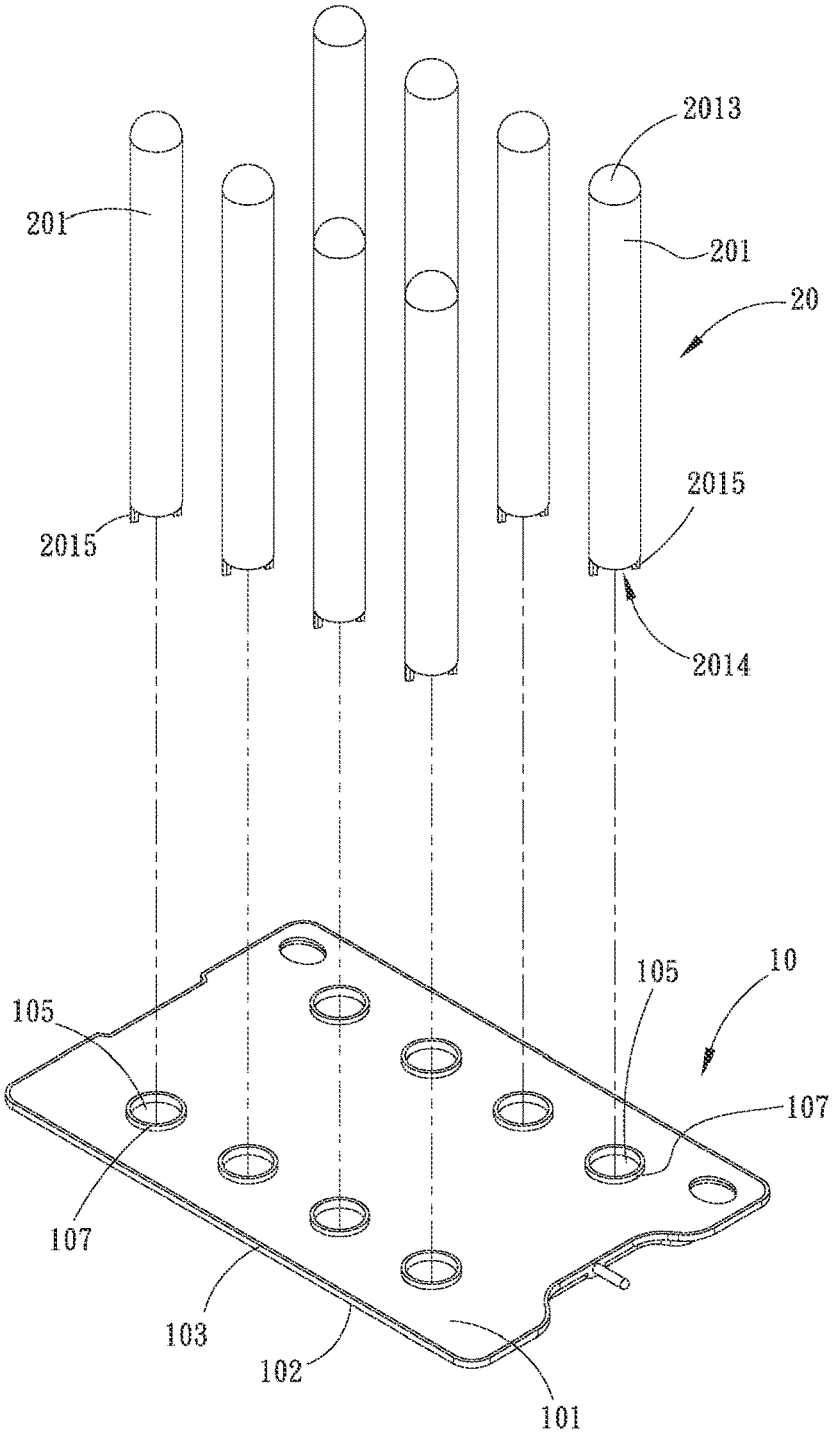
FIG. 1 is an assembled perspective view of the heat dissipation device according to a first embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
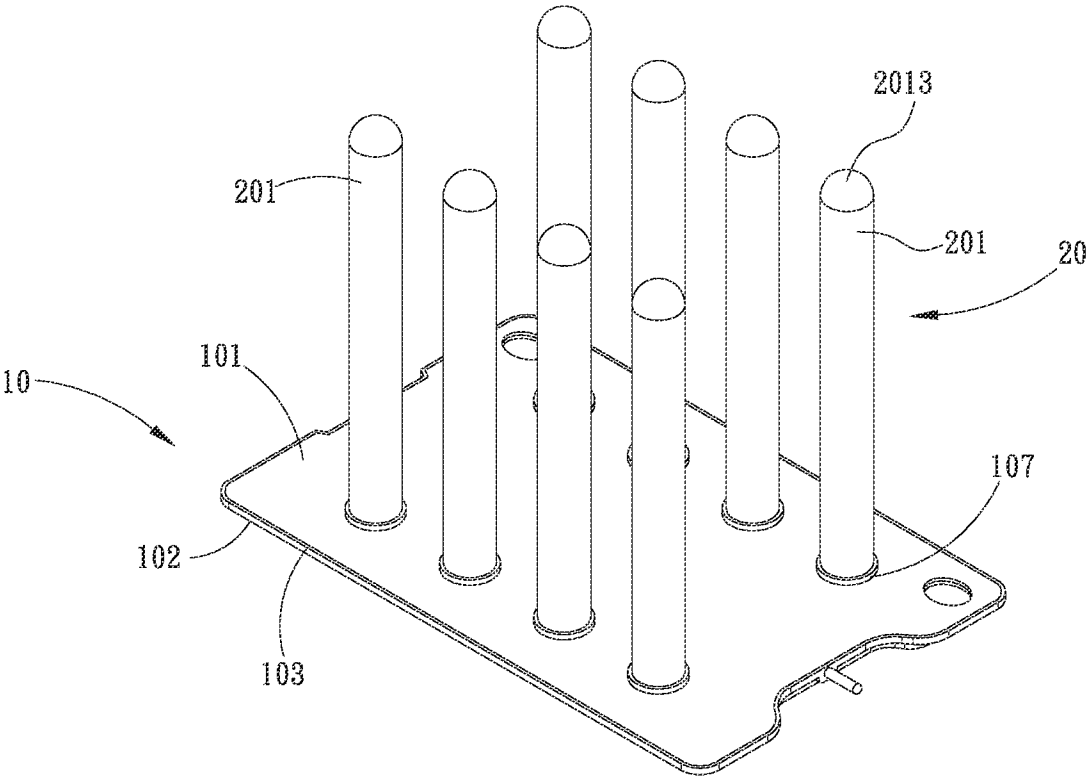
FIG. 2 is an assembled perspective view of FIG. 1.

Please refer to FIGS. 1 and 2, which are exploded and assembled perspective view, respectively, of a heat dissipation device according to a first embodiment of the present invention. As shown, the heat dissipation device includes a housing 10 and a heat pipe 20. In this illustrated first embodiment, the housing 10 can be, for example but not limited to, a vapor chamber. The housing 20 has 1 top side 101, a bottom side 102, a lateral side 103, a housing chamber 1044, and at least one opening 105. The lateral side 103 is formed between the top and the bottom side 101, 102, and the housing chamber 1044 is defined between the top, the bottom, and the lateral side 101, 102, 103. A working fluid, such as pure water or methanol) and a wick structure 106 are provided in the housing chamber 1044. The housing 10 is a vapor chamber or a heat pipe In this illustrated first embodiment, the housing wick structure 106 can be, for example but not limited to, sintered powder structure, or grid body, grooves, or composite wick structure in other embodiments. The opening 105 is extended through the top side 101 of the housing 10 and communicated with the housing chamber 1044. The opening 105 is formed on the top side 101 adjacent to the lateral side 103 of the housing 10, and the number of the opening 105 can be eight in the first embodiment. In practical implementation, the opening 105 can be one or more, and the number thereof is corresponding to the number of the heat pipe 20.

In the first embodiment, there are eight heat pipes 20, and each of which has a heat pipe wall 201, a heat pipe wick structure 202, a closed end 2013, and an open end 2014. The heat pipe wick structure 202 can be a sintered powder structure, and in practical implementation, other wick structure, such as grid body, grooves, or composite wick structure, can be used. The heat pipe wall 201 has an outer and an inner side 2011, 2012, and the inner side 2012 of the heat pipe wall 201 internally defines a heat pipe chamber 2016 communicated with the open end 2014. The heat pipe wick structure 202 is formed on the inner side 2012 of the heat pipe wall 201. The open end 2014 of the heat pipe 20 is correspondingly inserted into the opening 105 of the housing 10. The heat pipe chamber 2016 is vertically communicated with the housing chamber 1044 via the open end 2014 of the heat pipe 20, and the rest of the heat pipe 20 is exposed from the housing 10. With the heat pipe 20 is connected to and communicated with the housing 10 of the present invention, there is no heat resistance between the heat pipe 20 and the housing 10. In the first embodiment, the rest of heat pipe 20, i.e. dissipation portion of the heat pipe 20, is, for example but not limited to, vertically exposed from the housing 10. In the practical implementation, the dissipation portion of the heat pipe 20 can be other configurations, such as N-shaped.

Also, an extended portion 2015 is integrally extended from the open end 2014 of the heat pipe 20, and pressed against the bottom side 102 in the housing chamber 1044 of he housing 10, that is, the extended portion 2015 is downwardly extended from the open end 2014 of the heat pipe 20 to connect to the bottom side 102 in the housing chamber 1044 of the housing 10, and the outer side 2011 of the heat pipe wall 201 is tightly connected to the opening 105 of the housing 10. A slot or an opening is formed between the open end 2014 and the extended portion 2015 of the heat pipe 20. The extended portion 2015 is part of the heat pipe wall 201, so the inner side 2012 of the extended portion 2015 is the inner side 2012 of the heat pipe wall 201.

With the extended portion 2015 integrally extended from the open end 2014 of the heat pipe 20 being connected to the bottom side 102 in the housing chamber 1044 and the outer side 2011 of the heat pipe wall 201 being connected to the inner wall of the opening 105 of the housing 10 as a support structure, such that there is no need to provide a copper column to connect the top side 101 to the bottom side 102. That is, in the housing chamber 1044 there is no a copper column as the conventional vapor chamber, so as to save the manufacturing cost.

Figure 4:
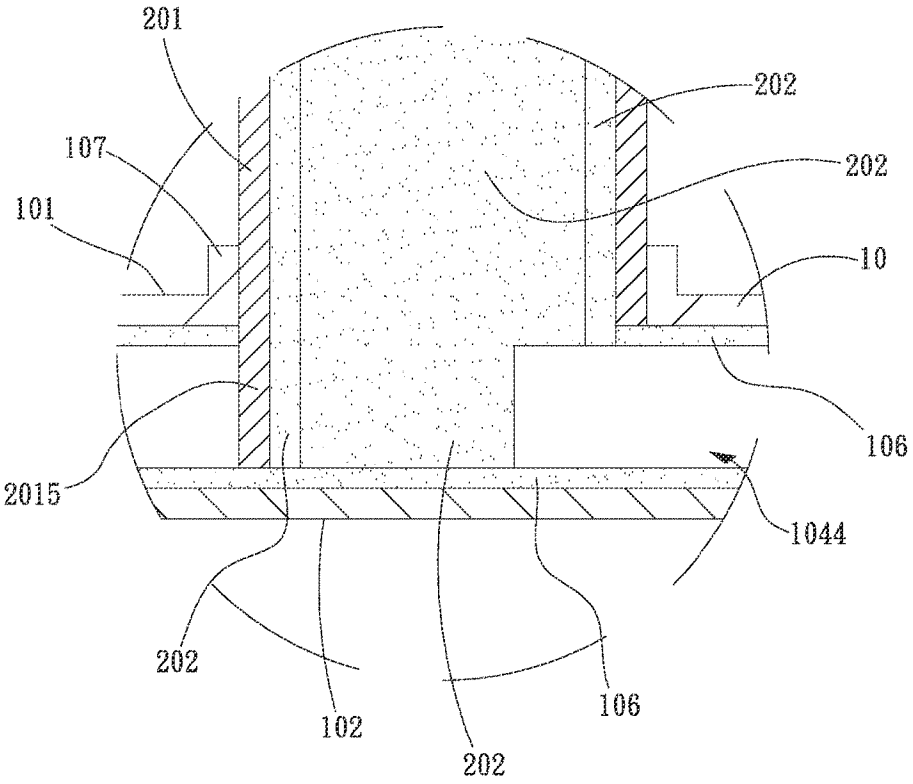
FIG. 4 is an enlarged view of the circled area of FIG. 3.

The heat pipe wick structure 202 is connected to the housing wick structure 106 as shown in FIG. 4. Also, the heat pipe wick structure 202 formed on the inner side 2012 of the extended portion 2015 is porously connected to the housing wick structure 106 in the housing chamber 1044 on the bottom side 102, whereas the heat pipe wick structure 202 formed on the inner side 2012 of the open end 2014 is porously connected to the housing wick structure 106 in the housing chamber 1044 on the top side 101, such that the working fluid is condensed into liquid. The liquid working fluid then flows from the heat pipe wick structure 202 back to the housing wick structure 106 with the help of a capillary force, then to the housing chamber 1044 of the housing 10.

With the heat pipe wick structure 202 connected to the housing wick structure 106, the condensed working fluid in the closed end 2013 on the heat pipe wall 201 can quickly flow back to the housing wick structure 106 on the bottom side 102 of the housing 10 via the heat pipe wick structure 202 on the extended portion 2015, so as to increase heat transfer effect and vapor/liquid circulation efficiency.

U, MCU, or other electronic elements, the bottom side 102 of the housing 10 absorbs heat produced by the heat-generating element and the working fluid located at the housing wick structure 106 on the bottom side 102 in the housing chamber 1044 is heated and vaporized. The vaporized working fluid flows through the housing chamber 1044 to the top side 101. Meanwhile, part of the vaporized working fluid flows through the heat pipe chamber 2016 via the open end 2014 of the heat pipe 20, at where the working fluid is condensed into liquid. The liquid working fluid in the heat pipe chamber 2016 on the closed end 2013 then flows back to the housing chamber 106 on the bottom side 102 with the help of a capillary force of the heat pipe wick structure 202. Since the heat pipe and the vapor chamber are known in the art, they are not discussed in more details herein. Therefore, the vapor-liquid circulation continuously occurred therein.

Furthermore, the housing 10 has at least one raised portion 107, which is upwardly extended from the periphery of the opening 105 of housing 10, and an inner wall of the opening 105 together an inner side 2012 of the raised portion 107 of the housing 10 is connected to the outer side 2011 of the heat pipe 20, such that the heat pipe 20 is tightly connected to the housing 10 and has increased contact area with.

Figure 3:
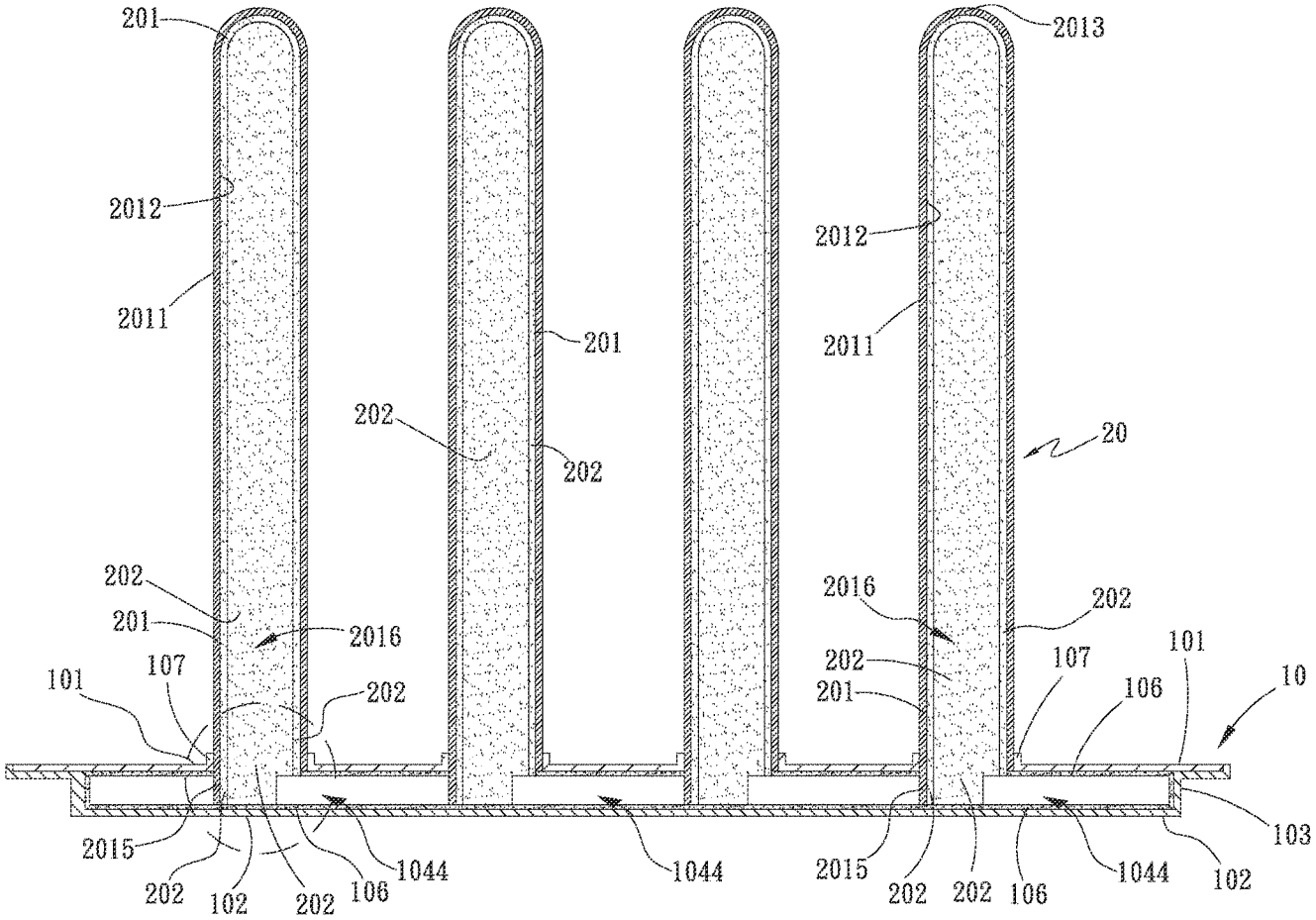
FIG. 3 is a sectional view of FIG. 2.
Figure 5:
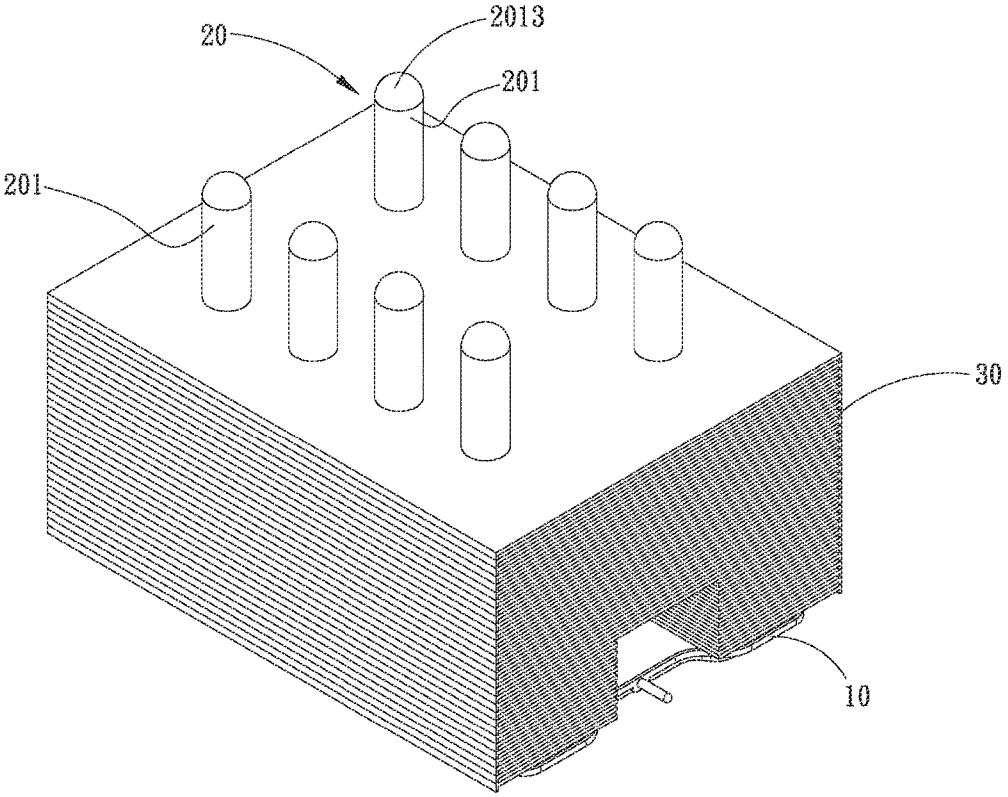
FIG. 5 is a perspective view showing the heat dissipation device combined with a heat radiation fin assembly according to the first embodiment of the present invention.

Please refer to FIG. 5, which is a perspective view showing the heat dissipation device combined with a heat radiation fin assembly according to the first embodiment of the present invention, along with FIGS. 1 and 3. As shown, a heat radiation fin assembly 30 composed of a plurality of heat radiation fins is extended through the heat pipe 20 and the dissipation portion of the heat pipe 20 is exposed from the heat radiation fin assembly 30. With the larger contact area of the heat radiation fin assembly 30, the heat pipe wall 201 exposed from the heat radiation fin assembly 30 can quickly dissipate the heat into the ambient air, so as to increase heat transfer effect.

Figure 6:
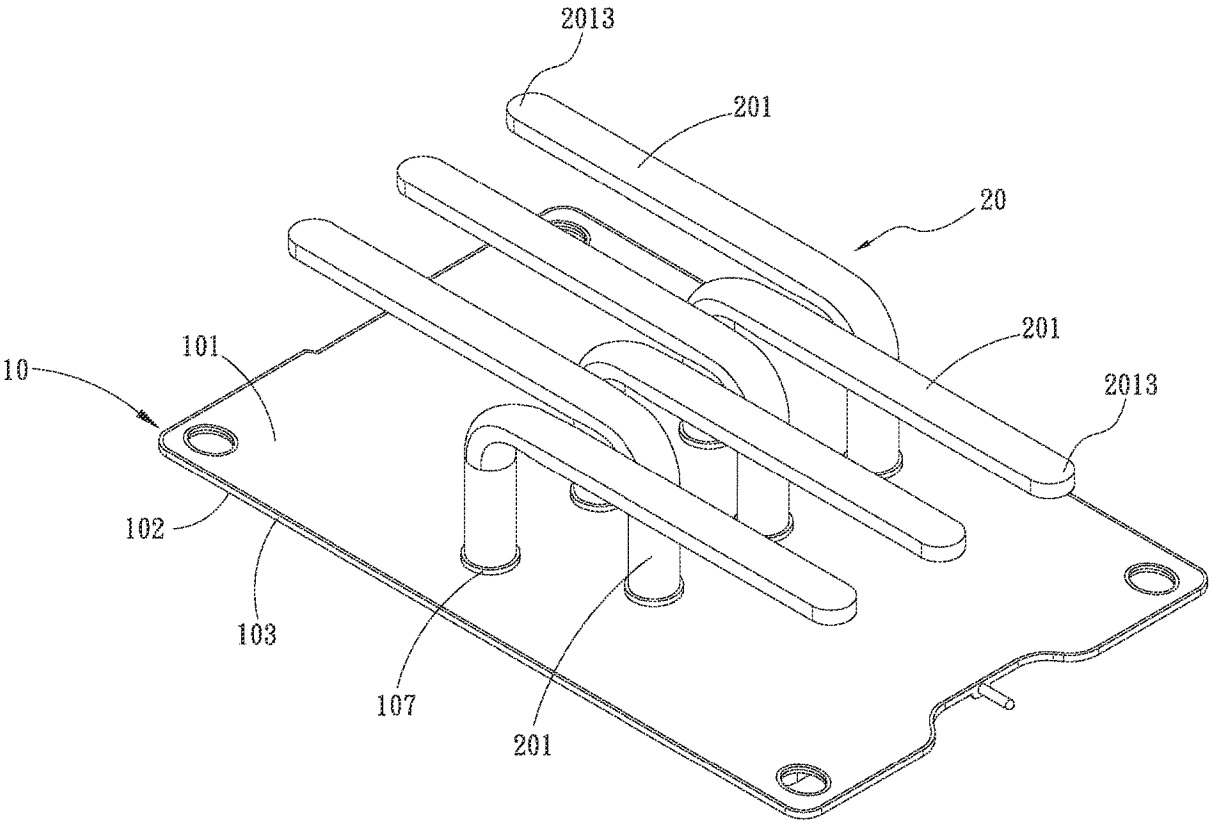
FIG. 6 is an assembled perspective view of the heat dissipation device according to a second embodiment of the present invention.

Please refer to FIG. 6, which is an assembled perspective view of the heat dissipation device according to a second embodiment of the present invention. The second embodiment of the heat dissipation base is generally structurally similar to the first embodiment except that, in this second embodiment, there are six heat pipes, which are provided on the housing 10, and the dissipation portion, i.e. the portion of each the heat pipe 20 exposed from the housing 20 is L-shaped. Also, the dissipation portions of the heat pipes 20 can be radially outward extended in different directions to be in a staggered relation with respect to one another. The L-shaped heat dissipation portion of the heat pipe 20 is flat pipe and parallel to the top side 101 of the housing 10.

Figure 7:
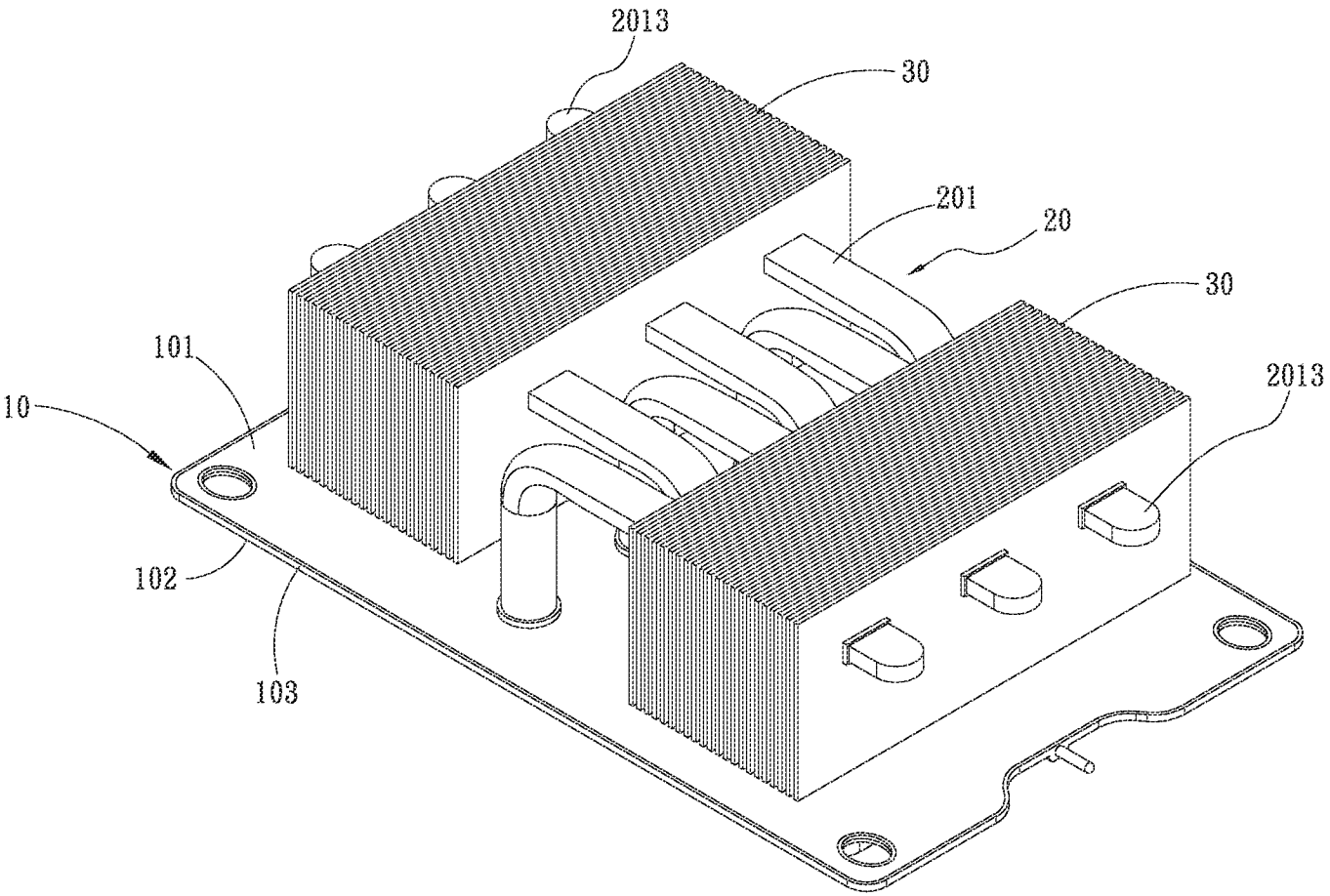
FIG. 7 is a perspective view showing the heat dissipation device combined with a heat radiation fin assembly according to the second embodiment of the present invention.

Please refer to FIG. 7, which is a perspective view showing the heat dissipation device combined with a heat radiation fin assembly according to the second embodiment of the present invention. As shown, at least one heat radiation fin assembly 30 composed of a plurality of heat radiation fins is extended through the heat pipe 20 and the dissipation portion of the heat pipe 20 is exposed from the heat radiation fin assembly 30. With the larger contact area of the heat radiation fin assembly 30, the heat pipe wall 201 exposed from the heat radiation fin assembly 30 can quickly dissipate the heat into the ambient air, so as to increase heat transfer effect.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A heat dissipation device, comprising:

a housing having a housing chamber and at least one opening; the housing chamber having a working fluid and a housing wick structure forming on an inner surface of the housing chamber; and the opening is extended through a top side of the housing and communicated with the housing chamber;

a heat pipe having a heat pipe wall, a closed end, and an open end; the heat pipe wall having an outer and an inner side; an extended portion in which the heat pipe wall is partially cut away as a notch being integrally extended from the open end, the inner side of the heat pipe wall internally defining a heat pipe chamber communicated with the open end, and a heat pipe wick structure formed on the inner side of the heat pipe wall; and the open end of the heat pipe being inserted into the opening of the housing, and the extended portion of the open end of the heat pipe being connected to a bottom side of the housing chamber with an upper edge of the notch being flush with the upper wick structure of the housing and a vertical edge of the notch perpendicular to the top upper edge of the notch and forming a housing support; the heat pipe chamber being connected to the housing chamber via the open end of the heat pipe, and the heat pipe wick structure being in contact with the housing wick structure.

2. The heat dissipation device as claimed in claim 1, wherein the heat pipe wick structure formed on the inner side of the heat pipe wall is connected to the housing wick structure formed on the top side in the housing chamber of the housing, whereas the heat pipe wick structure in the extended portion of the heat pipe is connected to the housing wick structure on the bottom side in the housing chamber of the housing.

3. The heat dissipation device as claimed in claim 2, wherein the housing has at least one raised portion, which is upwardly extended from the periphery of the opening of housing, and an inner wall of the opening together an inner side of the raised portion of the housing is connected to the outer side of the heat pipe.

4. The heat dissipation device as claimed in claim 1, wherein the housing further includes a lateral and a bottom side, which is formed between the top and the bottom side, and the housing chamber is defined between the top, the bottom, and the lateral side.

5. The heat dissipation device as claimed in claim 1, wherein the housing is selected from the group consisting of a vapor chamber and a heat pipe.

6. The heat dissipation device as claimed in claim 1, wherein a heat radiation fin assembly is vertically extended through the heat pipe and connected to the outer side of the heat pipe wall of the heat pipe.

7. The heat dissipation device as claimed in claim 1, wherein a slot is formed between the open end and the extended portion of the heat pipe.

* * * * *